US006610339B1

(12) United States Patent
Borgerson

(10) Patent No.: US 6,610,339 B1
(45) Date of Patent: Aug. 26, 2003

(54) BOWL-IN-ONE

(75) Inventor: Michael J. Borgerson, Battle Creek, MI (US)

(73) Assignee: Kellogg Company, Battle Creek, MI (US)

( * ) Notice: Subject to any disclaimer, the term of this patent is extended or adjusted under 35 U.S.C. 154(b) by 0 days.

(21) Appl. No.: 09/677,694

(22) Filed: Sep. 29, 2000

Related U.S. Application Data

(60) Provisional application No. 60/156,839, filed on Sep. 30, 1999.

(51) Int. Cl.[7] ..... B65D 25/08; B65D 81/32

(52) U.S. Cl. ..... 426/120; 426/115; 426/394; 426/112; 206/219; 206/222; 215/DIG. 8; 220/501

(58) Field of Search ..... 429/112, 115, 429/120, 124, 394; 206/219, 221, 222; 220/500, 501, 502, 506; 215/DIG. 8, 250, 6, 10; 604/416; 426/398

(56) References Cited

U.S. PATENT DOCUMENTS

| | | | | | |
|---|---|---|---|---|---|
| 2,677,459 | A | * | 5/1954 | Ritzenberg | |
| 4,024,952 | A | * | 5/1977 | Leitz | 206/221 |
| 4,132,308 | A | * | 1/1979 | Goncalves | 206/219 |
| 4,177,938 | A | * | 12/1979 | Brina | 222/80 |
| 4,195,730 | A | * | 4/1980 | Hunt | 206/221 |
| 4,591,050 | A | * | 5/1986 | Finke et al. | 206/222 |
| 4,682,689 | A | * | 7/1987 | Pereira et al. | 206/222 |
| 4,773,529 | A | * | 9/1988 | Finke et al. | 206/222 |
| 4,793,475 | A | * | 12/1988 | Itzel | 206/221 |
| 4,793,476 | A | * | 12/1988 | Schrupp | 206/222 |
| 5,209,348 | A | * | 5/1993 | Schafer | 206/222 |
| 5,514,394 | A | | 5/1996 | Lenahan | 426/120 |
| 5,540,326 | A | * | 7/1996 | Arnold et al. | 206/221 |
| RE35,437 | E | | 2/1997 | Ascone | 62/372 |
| 5,706,980 | A | * | 1/1998 | Dickerson | 222/129 |
| 5,727,679 | A | | 3/1998 | Newarski | 206/222 |

FOREIGN PATENT DOCUMENTS

| | | | |
|---|---|---|---|
| FR | 2694542 | A1 * | 2/1994 |
| GB | 2298406 | A * | 4/1996 |
| JP | 06080166 | A * | 3/1994 |
| WO | WO0029305 | A2 * | 5/2000 |

* cited by examiner

*Primary Examiner*—Steve Weinstein
*Assistant Examiner*—Robert A. Madsen
(74) *Attorney, Agent, or Firm*—Howard & Howard

(57) ABSTRACT

A portable container for storing an edible liquid separate from an edible dry component is disclosed. The container permits a user to easily mix the edible liquid with the dry component in a readily transportable container without spilling the contents. A portable container includes an outer vessel having a least one internal projection and an inner vessel received within the outer vessel. The inner vessel is rotatable within the outer vessel and includes a removable top and at least one opening covered by a frangible membrane. A sealing member seals the outer vessel to the inner vessel. When the inner vessel is rotated within the outer vessel the at least one internal projections ruptures the frangible membrane and provides communication between the inner vessel and the outer vessel. An edible liquid is stored within an inner space defined between the inner vessel and the outer vessel and a dry component is stored within the inner vessel. Thus, when the frangible membrane is ruptured the edible liquid is mixed with the edible dry component.

12 Claims, 5 Drawing Sheets

BOWL-IN-ONE

This application claims the benefit of U.S. Provisional Application No. 60/156,839, filed Sep. 30, 1999.

BACKGROUND OF THE INVENTION

The present invention relates to a portable container for solid and liquid foods, such as cereal and milk. The present invention accommodates a busy lifestyle by allowing people to take mixable liquid and solid foods with them in a single package, to be mixed and consumed at their convenience.

Various types of containers for holding liquid and solid foods, such as milk and cereal, have previously been developed. For example, Ascone U.S. Re. Pat. No. 35,437 discloses a reusable milk and cereal container having a removable freeze pack adjacent a milk compartment, separate milk and cereal compartments with a valve interposed therebetween, and an optional detachable spoon.

Lenahan U.S. Pat. No. 5,514,394 discloses a container for mixing cereal and milk, where the contents are kept in separate compartments and are mixed by applying hand pressure to the container.

Newarski U.S. Pat. No. 5,727,679 discloses a single use cereal and milk container of plastic or paperboard, wherein the contents are mixed by means of removing a seal from the cereal compartment and opening a valve in the milk compartment. All references cited herein are incorporated by reference.

The present invention provides a more convenient portable edible liquid and edible solid container than the containers already known in the art. The easy-to-transport, portable container of the present invention enables the consumer to easily mix the dry and liquid ingredients, without worrying about spilling the contents, and to subsequently easily eat the mixed components. One embodiment of the container fits automobile cup holders. The container is resealable after opening and preferably includes a spoon.

SUMMARY OF THE INVENTION

The present invention provides a portable single container for storing an edible liquid separate from an edible dry component. The present invention permits a user to easily mix the liquid with the dry component without spilling the contents in a readily transportable container.

In one embodiment, the present invention is a portable container for transporting a solid and a liquid and comprises an outer vessel having at least one internal projection; an inner vessel received in the outer vessel, the inner vessel is rotatable within the outer vessel and has a removable top and at least one opening covered by a frangible membrane. A sealing member seals the outer vessel to the inner vessel. When the inner vessel is rotated within the outer vessel the at least one internal projection ruptures the frangible membrane and provides.

The present invention further comprises a method for storing an edible liquid separate from an edible solid in a container and subsequently mixing the liquid with the solid in the container. The present method comprises the steps of: providing a container having an outer vessel and an inner vessel, the outer vessel having at least one internal projection and the inner vessel having a removable top and at least one opening covered by a frangible membrane; placing the inner vessel into the outer vessel to define an inner space between them; placing an edible liquid in the inner space and an edible solid in the inner vessel; sealingly joining the inner vessel to the outer vessel; and rotating the inner vessel within the outer vessel, thereby causing the at least one internal projection to rupture the frangible membrane and permit mixing of the edible liquid with the edible solid.

These and other features and advantages of this invention will become more apparent to those skilled in the art from the detailed description of a preferred embodiment. The drawings that accompany the detailed description are described below.

DESCRIPTION

Figure 1:
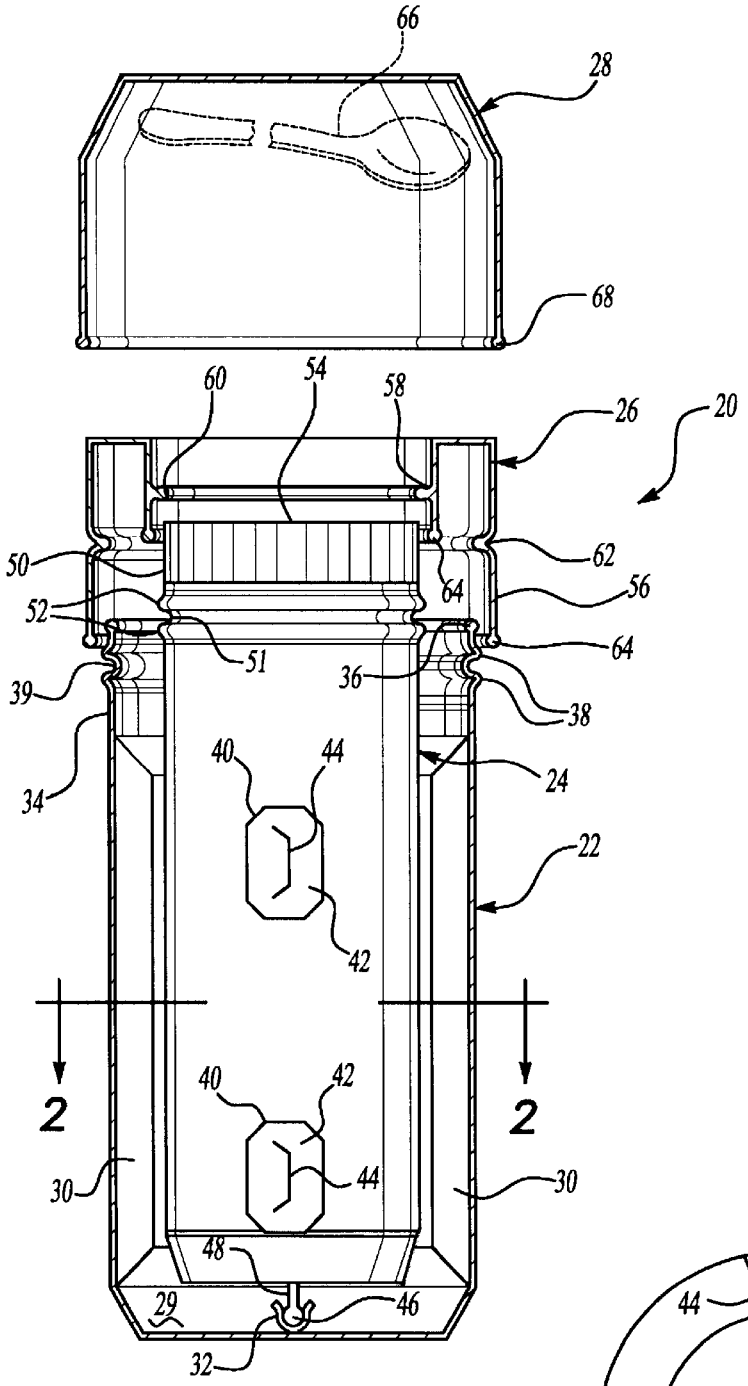
FIG. 1 is an exploded cut-away view of a container designed in accordance with the present invention.

Referring to the Figures, wherein like numerals indicate like or corresponding parts throughout the several views, in FIG. 1 a portable container according to the present invention is generally indicated at 20. Container 20 includes an outer vessel 22 having a first length, an inner vessel 24 having a second length substantially the same as said first length, a sealing member 26, and a lid 28. Inner vessel 24 is received within outer vessel 22 and sealing member 26 seals inner vessel 24 to outer vessel 22. An inner space 29 is defined between inner vessel 24, outer vessel 22, and sealing member 26. Outer vessel 22 further includes a plurality of projections 30 that are disposed on a sidewall of the outer vessel 22 and extend or project radially inwardly therefrom into inner space 29. In one embodiment, projections 30 are V-shaped fins. In a preferred embodiment, container 20 includes a plurality of projections 30, but as would be understood by one of ordinary skill in the art and as explained below, container 20 could be formed with a single projection 30. Outer vessel 22 further includes a socket 32 formed in one end of outer vessel 22. Socket 32 is centrally located. Opposite socket 32, outer vessel 24 includes an upper rim 34. Upper rim 34 includes a plurality of ribs 36 and 38. A groove 39 is formed between two of the ribs 38.

Figure 2:
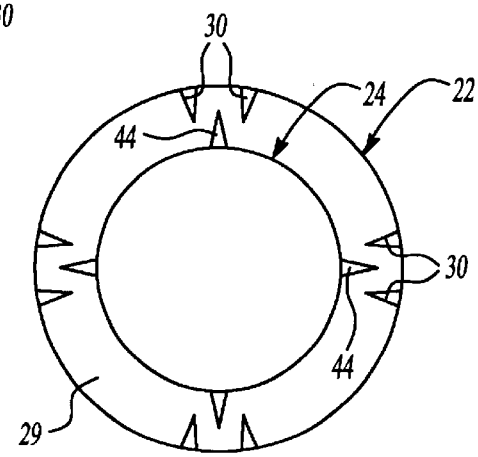
FIG. 2 is a view along line I—I of FIG. 1.

Inner vessel 24 includes a plurality of openings 40. In one embodiment, inner vessel 24 includes a first plurality of openings 40 adjacent one end of inner vessel 24 and a second plurality of openings 40 adjacent a second end of inner vessel 24 and spaced apart from the first plurality of openings as shown in FIG. 1. The openings 40 are defined in a sidewall of the inner vessel 24. Each of the openings 40 is covered by a frangible membrane 42. In a preferred embodiment, frangible membranes 42 each include a projection 44 which extends away from frangible membrane 42 and into inner space 29. Each of the frangible membranes 42 and accompanying projections 44 form a frangible component. As best shown in FIG. 2, the projections 44 of the frangible component are disposed on the fragible membrane 42 and extend radially outwardly therefrom. In one embodiment, the projections 44 are V-shaped fins. Inner vessel 24 includes a ball 46 mounted to a stem 48 which extends centrally from one end of inner vessel 24. Ball 46 is received rotatably in socket 32. This provides a rotatable connection between inner vessel 24 and outer vessel 22. As would be understood by one of ordinary skill in the art, the rotatable connection between the inner vessel 24 and the outer vessel 22 could take a number of other forms including, for example, a simple projection extending from inner vessel 24 that is received in a depression in outer vessel 22 (not shown). Inner vessel 24 further includes an upper rim 50 having at least one groove 51 bounded by a plurality of ribs 52. Inner vessel 24 further includes a removable top 54. Preferably, removable top 54 includes internal threads, which threadingly engage external threads adjacent upper rim 50 of inner vessel 24 (not shown).

In one embodiment, sealing member 26 comprises a U-shaped annular member having a long leg 56 and a short leg 58. Long leg 56 includes a groove 62 and a rib 64. Short leg 58 includes a pair of ribs 60 and 64.

Lid 28 includes a rib 68 and preferably accommodates a spoon 66.

FIG. 2 is a view along line I—I of FIG. 1. In the embodiment shown in FIG. 2, outer vessel 22 includes a pair of projections 30 located adjacent each of the projections 44 of frangible membranes 42. As would be understood by one of ordinary skill in the art, container 20 could be designed with either a single projection 30 or a single projection 30 adjacent each projection 44.

Figure 3:
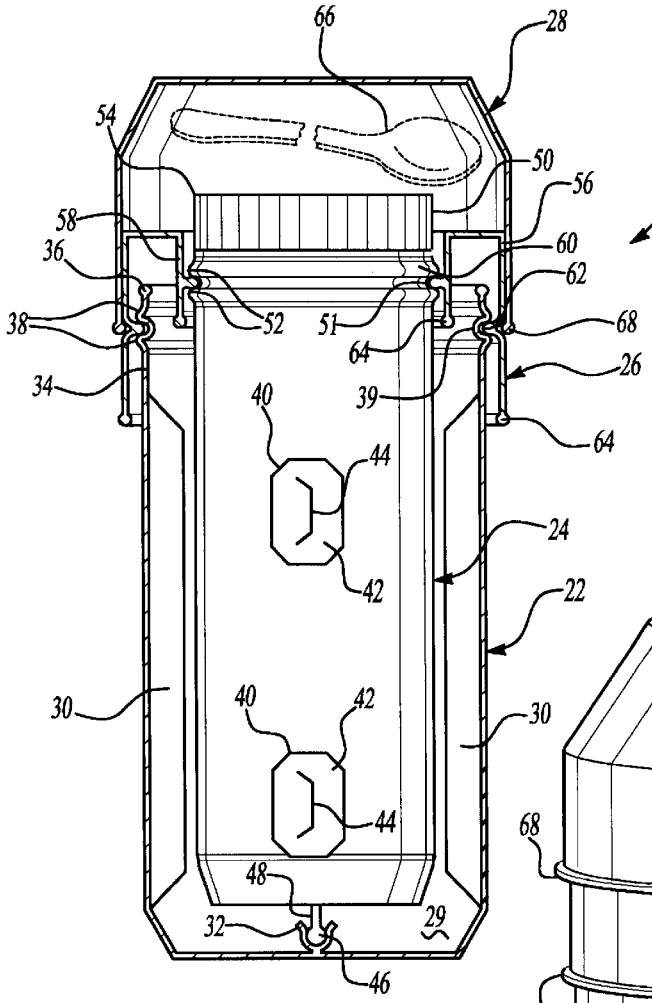
FIG. 3 is a cut-away view of the container of FIG. 1 assembled.

FIG. 3 is a cut-away view of container 20 shown fully assembled. When container 20 is assembled the inner vessel 24 is inserted into outer vessel 22 and inner vessel 24 is loaded with an edible dry product 70, see below. An edible liquid is then placed in inner space 29. Then sealing member 26 is secured to outer vessel 22 and inner vessel 24 to seal outer vessel 22 to inner vessel 24 and to seal the edible liquid within inner space 29. In the embodiment shown in FIG. 3, rib 60 of short leg 58 of sealing member 26 is received in groove 51 of inner vessel 24. In addition, rib 64 of short leg 58 contacts inner vessel 24. This seals sealing member 26 to inner vessel 24. Groove 39 of outer vessel 22 receives groove 62 of sealing member 26. In addition, ribs 36 and 38 of outer vessel 22 engage sealing member 26 and rib 64 of sealing member 26 engages outer vessel 22. Thus, sealing member 26 is sealingly engaged with outer vessel 22. Rib 68 of lid 28 is received in groove 62 of sealing member 26 to sealingly secure lid 28 to sealing member 26. Container 20 can further include a tamper resistant outer covering surrounding lid 28, not shown, as is known in the art.

Figure 4:
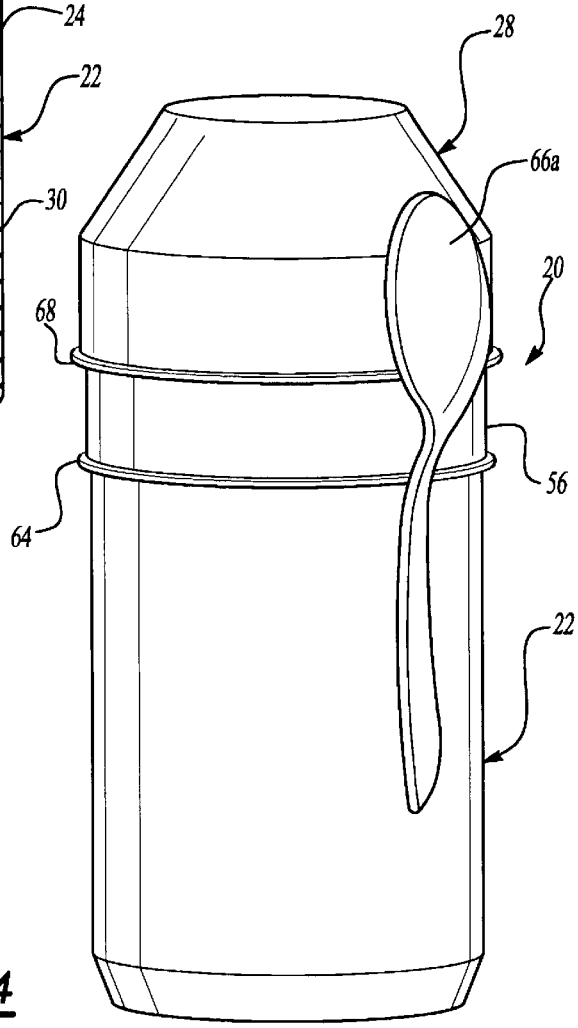
FIG. 4 is a perspective view of the container of FIG. 1 with an external spoon.
Figure 5:
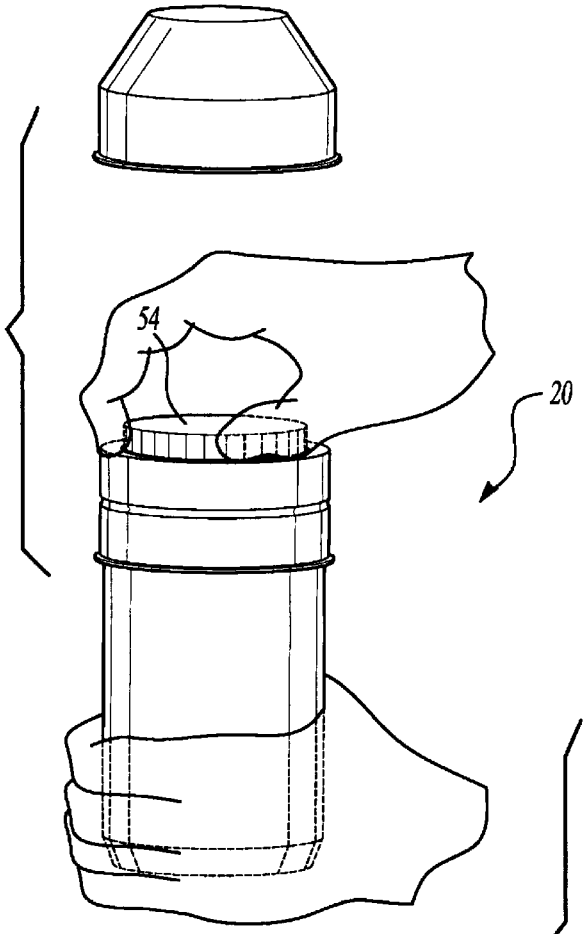
FIG. 5 is a perspective view of the container of FIG. 1, showing a consumer rotating the container's lid.
Figure 6:
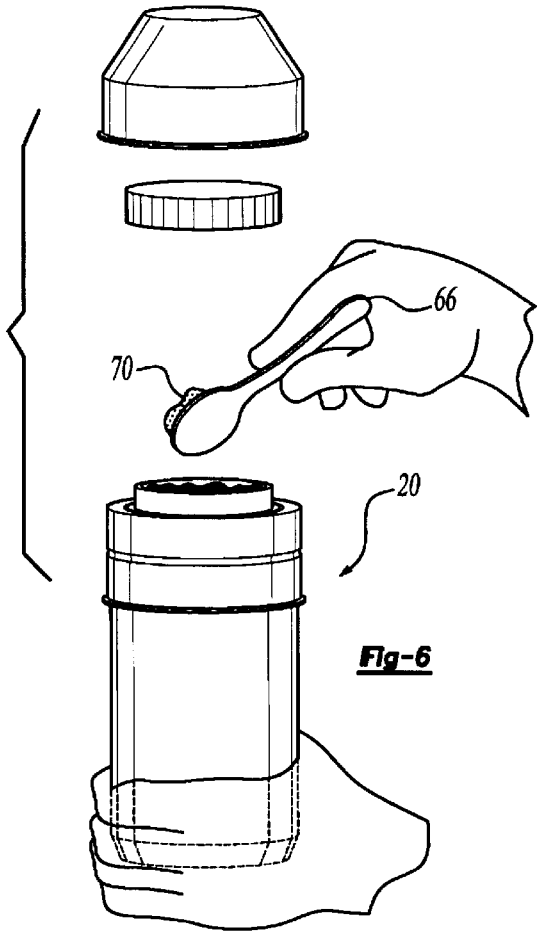
FIG. 6 is a perspective view of the container of FIG. 1 with the lid removed, showing a consumer eating cereal from the container.

As discussed above, inner vessel 24 contains an edible dry ingredient, such as for example, cereal. Inner space 29 contains an edible liquid, such as for example, milk. In FIG. 4, an alternative location for spoon 66*a* is shown. In this embodiment, spoon 66*a* is attached to the outside of container 20. In FIG. 5 a user is shown rotating removable top 54 to rotate inner vessel 24 within outer vessel 22. This rotation causes projections 30 to rupture frangible membranes 42 thereby causing communication between inner space 29 and inner vessel 24. This communication permits the edible liquid within inner space 29 to flow through openings 40 into inner vessel 24 thereby mixing the edible liquid with the edible dry ingredients within inner vessel 24. As shown in FIG. 6, once a user has removed removable top 54 a spoon 66 can be used to consume the edible ingredients 70 mixed with the edible liquid.

Figure 7:
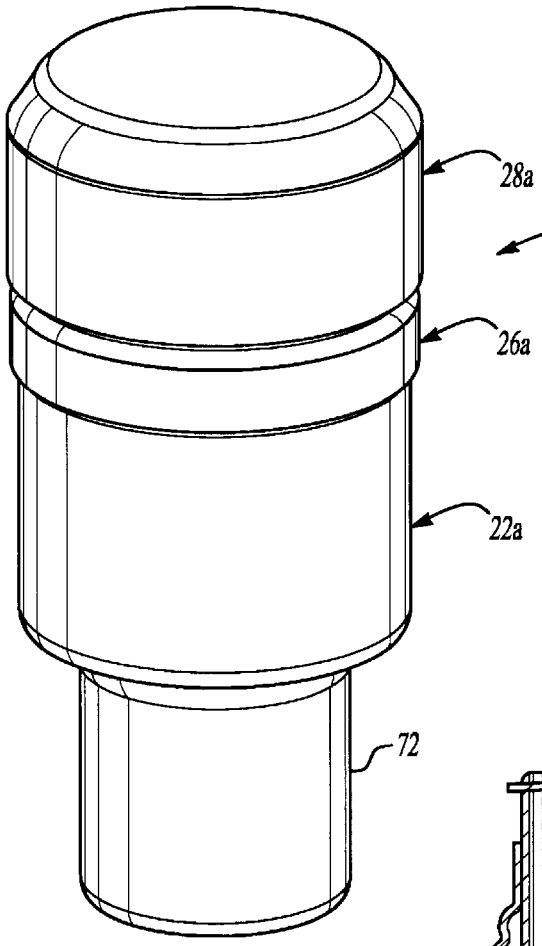
FIG. 7 is a perspective view of an alternative embodiment of the container.

In FIG. 7 a prospective view of an alternative embodiment of a container 20*a* is shown. Components 10 common between the embodiment shown in FIGS. 7–10 and FIG. 1 are designated with like numerals and the suffix "a". Container 20*a* includes an outer vessel 22*a*, a sealing member 26*a*, and a lid 28*a*. The outer dimensions of outer vessel 22*a* include a lower end 72 sized to be accommodated in an automobile cup holder.

Figure 8:
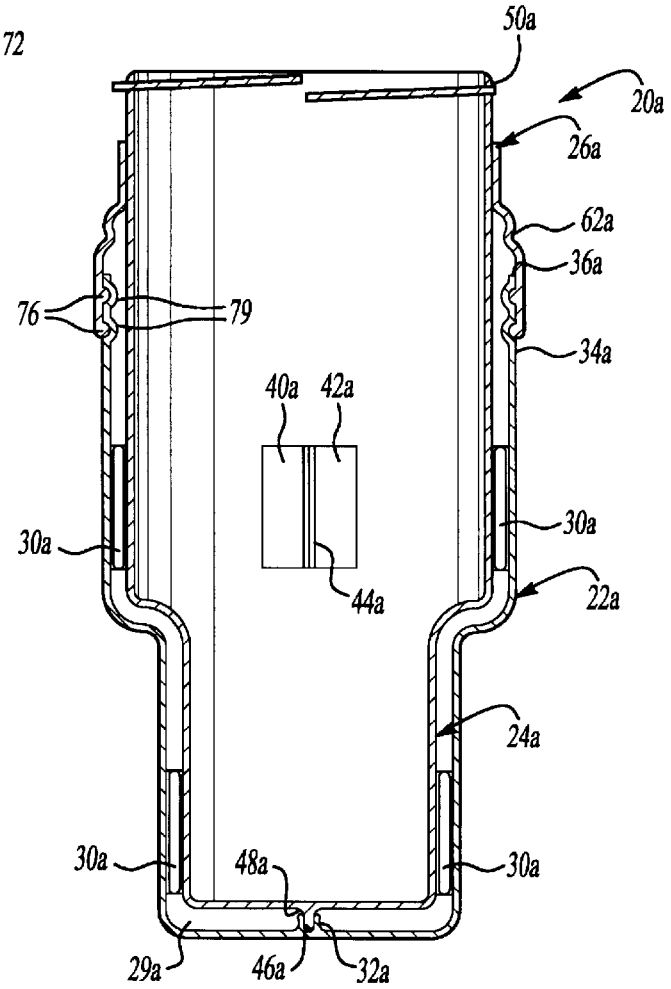
FIG. 8 is a partial cross-sectional view of the container of FIG. 7.
Figure 9:
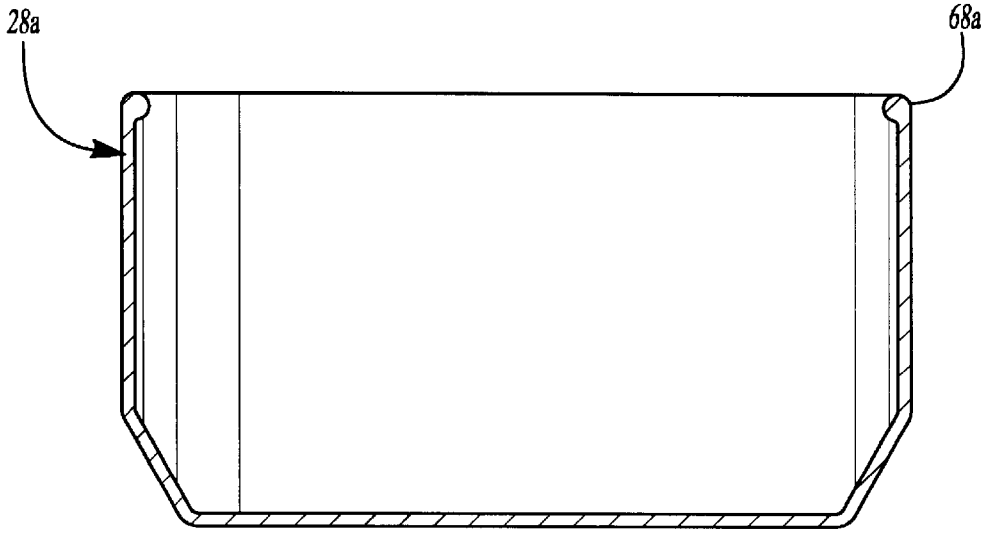
FIG. 9 is a cross-sectional view of a lid.
Figure 10:
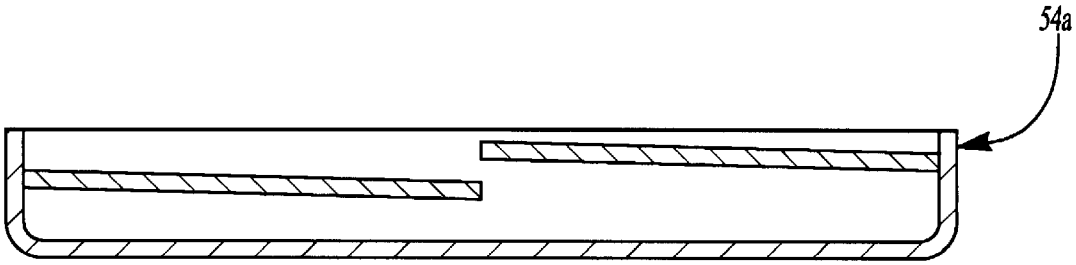
FIG. 10 is a cross-sectional view of a removable top.

FIG. 8 is a partial cross-sectional view of the container 20*a* of FIG. 7. Container 20*a* is similar to container 20 as shown in FIG. 1. The main differences between the embodiment shown and FIGS. 7–10 and FIGS. 1–6 reside in the contour of outer vessel 22*a*, which is followed by the contour of an inner vessel 24*a*. In addition, container 20*a* includes a sealing member 26*a* that is shaped somewhat differently from sealing member 26. Specifically, sealing member 26*a* includes a pair of ribs 76, which are received in a sealing manner in a pair of grooves 74 located in outer vessel 22*a*. Sealing member 26*a*is compression fit onto inner vessel 24*a* to provide a sealing connection between sealing member 26*a* and inner vessel 24*a*. As shown in FIGS. 10 and 9, container 20*a* includes a removable top 50*a*, which is threadingly received on inner vessel 24*a* adjacent upper rim 50*a*. In addition, lid 28*a* includes a rib 68*a*, which is received in groove 62*a* of sealing member 26*a* to seal lid 28*a* to container 20*a*.

Preferably the components of container 20 and 20*a* are formed out of a plastic material. But other suitable materials, such as for example, stainless steel are also acceptable.

The foregoing invention has been described in accordance with the relevant legal standards; thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A portable container for transporting a solid and a liquid comprising:

an outer vessel having a sidewall and al least one internal projection disposed on said sidewall and extending radially inwardly therefrom;

an inner vessel supported by said outer vessel and having a removable top and a sidewall defining at least one opening;

a frangible membrane covering said at least one opening;

at least one projection disposed on said frangible membrane and extending radially outwardly therefrom for radially overlapping and contacting said at least one internal projection of said outer vessel when said inner vessel is rotated relative to said outer vessel to rupture said frangible membrane thereby providing communication between said inner vessel and said outer vessel; and a sealing member sealing said outer vessel to said inner vessel.

2. A portable container as recited in claim 1 further including a rotatable connection between said inner vessel and said outer vessel.

3. A portable container as recited in claim 2, wherein said outer vessel includes a socket and said inner vessel includes a ball, received in said socket when said inner vessel is received in said outer vessel, whereby said ball and said socket form said rotatable connection.

4. A portable container as recited in claim 1 further comprising a removable lid, sealingly received on said sealing member.

5. A portable container as recited in claim 4 wherein one of said lid and said sealing member includes a rib and the other of said lid and said sealing member includes a groove, engaging said rib to seal said lid to said sealing member.

6. A portable container as recited in claim 1, wherein said inner vessel includes a first plurality of openings each covered by a frangible membrane and located adjacent first and second ends of said inner vessel with each of said frangible membranes having a projection disposed thereon and extending radially outwardly therefrom.

7. A portable container as recited in claim 1 wherein one of said sealing member and said outer vessel includes a rib and the other of said sealing member and said outer vessel includes a groove, engaging said rib to sealingly join said sealing member to said outer vessel.

8. A portable container as recited in claim 1 wherein one of said sealing member and said inner vessel includes a rib and the other of said sealing member and said inner vessel includes a groove, said groove engaging said rib to sealingly join said sealing member to said inner vessel.

9. A portable container as recited in claim 1 wherein said sealing member is sealingly compression fit onto said inner vessel to seal said sealing member to said inner vessel.

10. A portable container as recited in claim 1 wherein said at least one internal projection extending radially inwardly from said sidewall of said outer vessel and said at least one projection extending radially outwardly from said frangible membrane are V-shaped fins.

11. A portable container as recited in claim 1 wherein said outer vessel has a first length and said inner vessel has a second length substantially the same as said first length and wherein the sidewalls of said inner vessel and said outer vessel define an inner space between said vessel such that said at least one internal projection extends radially inwardly into said inner space and said at least one projection extends radially outwardly into said inner space in an overlapping relationship to said at least one internal projection.

12. A portable container comprising:

an outer vessel having a sidewall and at least one internal projection disposed on said sidewall and extending radially inwardly therefrom;

an inner vessel supported by said outer vessel and having a removable top and a sidewall defining at least one opening;

a sealing member sealing said outer vessel to said inner vessel;

an inner space defined between said outer vessel and said inner vessel;

an edible liquid disposed in said inner space;

an edible solid disposed in said inner vessel;

a frangible membrane covering said at least one opening; and at least one projection disposed on said frangible membrane and extending radially outwardly therefrom into said inner space for radially overlapping and contacting said at least one internal projection of said outer vessel when said inner vessel is rotated relative to said outer vessel to rupture said frangible membrane thereby providing communication between said inner vessel and said inner space and mixing said edible solid and said edible liquid.

* * * * *